US009389548B2

(12) United States Patent
Matsushita

(10) Patent No.: US 9,389,548 B2
(45) Date of Patent: Jul. 12, 2016

(54) IMAGE FORMING APPARATUS HAVING PHOTOSENSITIVE DRUMS

(71) Applicant: CANON KABUSHIKI KAISHA, Tokyo (JP)

(72) Inventor: Mio Matsushita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/715,433

(22) Filed: May 18, 2015

(65) Prior Publication Data

US 2015/0338783 A1 Nov. 26, 2015

(30) Foreign Application Priority Data

May 23, 2014 (JP) ..... 2014-107608

(51) Int. Cl.
*G03G 15/16* (2006.01)

(52) U.S. Cl.
CPC ..... *G03G 15/1685* (2013.01); *G03G 15/161* (2013.01)

(58) Field of Classification Search
None
See application file for complete search history.

(56) References Cited

U.S. PATENT DOCUMENTS 6,134,415 A * 10/2000 Iwakura ..... B82Y 15/00 399/299
6,411,792 B2 * 6/2002 Hirai ..... 399/299
2005/0063739 A1 * 3/2005 Kobayashi ..... G03G 15/0131 399/299
2010/0021201 A1 * 1/2010 Tamaru ..... G03G 15/0121 399/113
2011/0318053 A1 * 12/2011 Yamashita ..... G03G 9/0804 399/112

FOREIGN PATENT DOCUMENTS

JP 2-123385 A 5/1990
JP 10097146 A * 4/1998
JP 2001-249519 A 9/2001
JP 2007-033938 A 2/2007
JP 2010-066452 A 3/2010
JP 2010-164798 A 7/2010

OTHER PUBLICATIONS

Machine trasnlation of Konno (1998).*
Yamamoto et al., Electrophotographic Color Printer Engine, OKI Technical Review, v. 64, p. 15 (Aug. 1998).*

* cited by examiner

*Primary Examiner* — David Gray
*Assistant Examiner* — Sevan A Aydin
(74) *Attorney, Agent, or Firm* — Canon USA, Inc. IP Division

(57) ABSTRACT

An image forming apparatus includes a first photosensitive member, having a first outer diameter, a toner image being formed on the first photosensitive member, and a second photosensitive member, having a second outer diameter, a toner image being formed on the second photosensitive member, the second outer diameter being greater than the first outer diameter. A second transfer roller in relation to the second photosensitive member is disposed on a downstream side of a first transfer roller in relation to the first photosensitive member in a conveyance direction of an intermediate transfer belt. A pressing force of the second transfer roller applied to the second photosensitive member is set to be greater than a pressing force of the first transfer roller applied to the first photosensitive member.

7 Claims, 10 Drawing Sheets

A CROWN AMOUNT:
(Dc1 – De1), (Dc2 – De2)

IMAGE FORMING APPARATUS HAVING PHOTOSENSITIVE DRUMS

BACKGROUND OF THE INVENTION

1. Field of the Invention

The present invention relates to an image forming apparatus (e.g., a copying machine, a printer, and a facsimile apparatus) that is operable according to an electrophotographic method.

2. Description of the Related Art

A tandem-type image forming apparatus is a conventionally known image forming apparatus that includes a plurality of image forming units sequentially disposed along a rotational path of an intermediate transfer member to form a full-color image using the electrophotographic method.

According to an intermediate transfer mechanism of the tandem-type image forming apparatus, the intermediate transfer member constantly contacts an electrophotographic sensitive member (i.e., a photosensitive member) at a primary transfer portion while the intermediate transfer member is moving along the rotational path thereof. Therefore, contact portions of the intermediate transfer member and the photosensitive member are gradually worn down due to friction and contact pressure. This will cause deteriorations in surface characteristics of the intermediate transfer member and the photosensitive member. In a case where the image forming apparatus performs a black monochrome image forming operation, there is a photosensitive member that is not used. If the non-used photosensitive member is forcibly caused to contact the intermediate transfer member, the photosensitive member will have an unnecessarily shortened life. In particular, if the conveyance speed of the photosensitive member is different from that of the intermediate transfer member, the abrasion amount of a surface layer of the photosensitive member will excessively increase and, as a result, the lifetime of the photosensitive member will be shortened.

On the other hand, it is conventionally known that an image forming apparatus can include a mechanism operable in a black monochrome mode to bring an intermediate transfer member out of contact with photosensitive members of other color image forming units. Further, Japanese Patent Application Laid-Open No. 2010-66452 discusses an image forming apparatus, especially a full-color copying machine for office use, in which only a photosensitive drum of a black image forming unit (i.e., a most-frequently used image forming unit) has a larger diameter.

Further, to solve a dropout problem, it is also conventionally known that an elastic intermediate transfer belt made of an elastic layer is employable as the intermediate transfer member. In general, the dropout possibly occurs when a larger pressure is applied to toner particles in a transfer operation because a part of the toner particles cannot be transferred to the intermediate transfer member and remains on the photosensitive member.

However, when an image forming unit is equipped with a larger-diameter photosensitive member, image defectiveness tends to occur due to abnormal discharge or deterioration in transfer property.

SUMMARY OF THE INVENTION

The following reasons are believed to be related to the occurrence of image defectiveness. An intermediate transfer member surface approaches adjacently to the photosensitive member at the primary transfer portion and is then separated from the photosensitive member after being nipped between the photosensitive member and a primary transfer member. A tiny discharge occurs in the above-mentioned processes. If the diameter of the photosensitive member is changed, the above-mentioned discharge state is changed correspondingly. In other words, the transfer property will change even when the transfer conditions remain the same. A nipping force per unit area between the photosensitive member and the intermediate transfer member is smaller when the photosensitive member has a larger diameter, compared to that of a smaller-diameter photosensitive member. Therefore, the larger-diameter photosensitive member tends to be influenced by vibrations. For example, if a tiny slip occurs between the intermediate transfer member and the photosensitive member at the primary transfer portion, toner scattering will occur due to flapping of the intermediate transfer member. Image density unevenness will become apparent in a comparison between a portion where the toner scattering occurs and a portion where the toner scattering does not occur. In other words, an uneven image will be formed. Further, due to the flapping of the intermediate transfer member, the distance between the photosensitive member and the intermediate transfer member fluctuates on an immediate downstream side of the primary transfer portion. This will cause image disturbance and image defectiveness because the abnormal discharge tends to occur.

In particular, when the intermediate transfer belt includes an elastic layer, a tiny slip tends to occur between the belt and the photosensitive member at the primary transfer portion. Further, in a case where the larger-diameter photosensitive member is placed at a downstream-most end, adverse influences of the above-mentioned toner scattering (i.e., uneven image) and abnormal discharge tend to become greater because the amount of toner particles to be overlapped there becomes greater.

An image forming apparatus according to the present invention includes a first photosensitive drum, having a first outer diameter, a toner image being formed on the first photosensitive drum, a second photosensitive drum, having a second outer diameter, a toner image being formed on the second photosensitive drum, the second outer diameter being greater than the first outer diameter, a movable endless intermediate transfer belt configured to temporarily carry the toner images transferred from the first and second photosensitive drums, a first transfer roller configured to be urged toward the first photosensitive drum across the intermediate transfer belt and configured to electrostatically transfer the toner image from the first photosensitive drum to the intermediate transfer belt, a rotation center of the first transfer roller being disposed on a downstream side of a rotation center of the first photosensitive drum by a first shift amount in a moving direction of the intermediate transfer belt, a second transfer roller configured to be urged toward the second photosensitive drum across the intermediate transfer belt and configured to electrostatically transfer the toner image from the second photosensitive drum to the intermediate transfer belt, a rotation center of the second transfer roller being disposed on a downstream side of a rotation center of the second photosensitive drum by a second shift amount, the second shift amount being greater than the first shift amount, in the moving direction of the intermediate transfer belt, a first urging member configured to urge the first transfer roller with a first urging force toward the first photosensitive drum, and a second urging member configured to urge the second transfer roller with a second urging force, the second urging force being greater than the first urging force, toward the second photosensitive drum.

Further, another image forming apparatus according to the present invention includes a first photosensitive drum capable of forming a toner image on a cylindrical body thereof having a first outer diameter, a second photosensitive drum capable of forming a toner image on a cylindrical body thereof having a second outer diameter, the second outer diameter being greater than the first outer diameter, a movable endless intermediate transfer belt configured to temporarily carry the toner images transferred from the first and second photosensitive drums, a first transfer roller having a first electric resistance value and configured to be urged toward the first photosensitive drum across the intermediate transfer belt in such a way as to electrostatically transfer the toner image from the first photosensitive drum to the intermediate transfer belt, a rotation center of the first transfer roller being disposed on a downstream side of a rotation center of the first photosensitive drum by a first shift amount in a moving direction of the intermediate transfer belt, and a second transfer roller having a second electric resistance value, the second electric resistance value being greater than the first electric resistance value and configured to be urged toward the second photosensitive drum across the intermediate transfer belt in such a way as to electrostatically transfer the toner image from the second photosensitive drum to the intermediate transfer belt, a rotation center of the second transfer roller being disposed on a downstream side of a rotation center of the second photosensitive drum by a second shift amount, the second shift being greater than the first shift amount, in the moving direction of the intermediate transfer belt.

Further features of the present invention will become apparent from the following description of exemplary embodiments with reference to the attached drawings.

DESCRIPTION OF THE EMBODIMENTS

Hereinafter, an image forming apparatus according to the present invention will be described in detail below with reference to attached drawings.

1. Entire Configuration and Operations of Image Forming Apparatus

Figure 1:
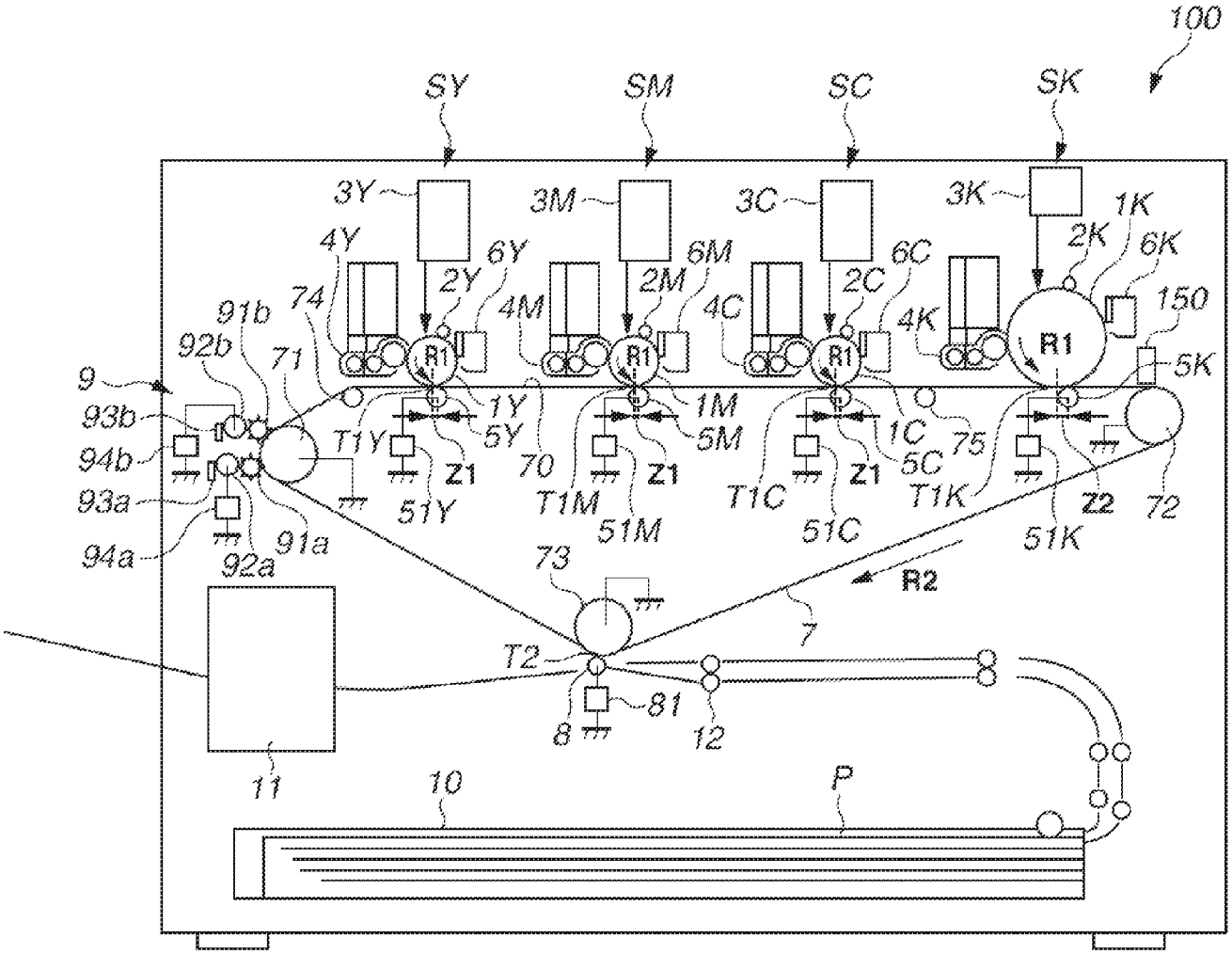
FIG. 1 is a schematic cross-sectional view of an image forming apparatus in a full-color mode.

FIG. 1 is a schematic cross-sectional view illustrating an image forming apparatus 100 according to a first exemplary embodiment of the present invention. The image forming apparatus 100 according to the present exemplary embodiment is a tandem-type laser beam printer using an intermediate transfer mechanism that can electrophotographically form a full-color image on a transfer material (e.g., a recording paper, an OHP sheet, and a cloth).

The image forming apparatus 100 includes first, second, third, and fourth image forming units SY, SM, SC, and SK as a plurality of image forming units (or stations). The image forming units SY, SM, SC, and SK can form yellow (Y), magenta (M), cyan (C), and black (K) images, respectively. The image forming units SY, SM, and SC, SK according to the present exemplary embodiment are similar to each other in configuration (e.g., constituent components and parts) and operations, although the colors of toner particles used for respective image forming units are different. Accordingly, unless specifically mentioned, each element may not be suffixed with Y, M, C, or K each indicating the color in a case where the element is inclusively described.

The image forming unit S includes a photosensitive drum 1, which is an electrophotographic sensitive member (i.e., a photosensitive member) having a drum shape (i.e., a cylindrical shape), and serves as a rotatably disposed image carrier. A driving motor (not illustrated), which is functionally operable as a driving unit, can rotate the photosensitive drum 1 in an arrow R1 direction in FIG. 1. The following process devices are disposed around the photosensitive drum 1. Firstly disposed around the photosensitive drum 1 is a charging roller 2 that is functionally operable as a charging unit. Secondly disposed around the photosensitive drum 1 is an exposure apparatus 3 that is functionally operable as an exposure unit. Thirdly disposed around the photosensitive drum 1 is a developing apparatus 4 that is functionally operable as a developing unit. Fourthly disposed around the photosensitive drum 1 is a drum cleaning apparatus 6 that is functionally operable as a photosensitive member cleaning unit. The developing apparatus 4 of each image forming unit S stores toner particles of the corresponding one of the yellow, magenta, cyan, and black colors. Further, in the present exemplary embodiment, a photosensitive drum 1K provided in the fourth image forming unit SK has a diameter that is greater than those of other image forming units SY, SM, and SC.

An intermediate transfer belt 7, which is made of an endless belt and serves as an intermediate transfer member, is disposed in such a way as to face the photosensitive drums 1 of respective image forming units S. The intermediate transfer belt 7 is tightly held by a driving roller 71, a tension roller 72, a secondary transfer counter roller 73, and push-up rollers 74 and 75, which serve as support members (i.e., tension rollers). The driving roller 71 can transmit a driving force to the intermediate transfer belt 7. The tension roller 72 can give a predetermined tension to the intermediate transfer belt 7. The secondary transfer counter roller 73 can serve as an opposing member (i.e., an opposing electrode) of a secondary transfer roller 8 described below. The push-up rollers 74 and 75 can cooperatively define a primary transfer plane 70 to transfer toner images onto the intermediate transfer belt 7. The above-mentioned four image forming units SY, SM, SC, and SK are linearly disposed along a horizontal portion of the primary transfer plane 70. The driving roller 71 can be rotated and driven by an appropriate driving motor (e.g., a pulse motor) that serves as a driving unit, although not illustrated in FIG. 1. Accordingly, the intermediate transfer belt 7 can cause a rotary motion (i.e., circumferentially moves) in an arrow R2 direction (which may be referred to as a "rotational direction" or a "conveyance direction" in the following description) illustrated in FIG. 1. Each tension roller other than the driving roller 71 can rotate around a rotational axis thereof according to the rotation of the intermediate transfer belt 7.

A primary transfer roller 5, which is a roller-shaped primary transfer member serving as a primary transfer unit, is disposed on an inner circumferential surface (i.e., a back surface) side of the intermediate transfer belt 7 at a position where the primary transfer roller 5 can face the photosensitive drum 1 of the corresponding image forming unit S. The primary transfer roller 5 is urged (or pushed) toward the photosensitive drum 1 via the intermediate transfer belt 7, in such a way as to form a primary transfer portion (i.e., a primary transfer nip) T1 at which the intermediate transfer belt 7 and the photosensitive drum 1 can be brought into contact with each other. Further, the secondary transfer roller 8, which is a roller-shaped secondary transfer member, serving as a secondary transfer unit, is disposed on an external circumferential surface side of the intermediate transfer belt 7 at a position where the secondary transfer roller 8 can face the secondary transfer counter roller 73. The secondary transfer roller 8 is urged (or pushed) toward the secondary transfer counter roller 73 via the intermediate transfer belt 7, in such a way as to form a secondary transfer portion (i.e., a secondary transfer nip) T2 at which the intermediate transfer belt 7 and the secondary transfer roller 8 are brought into contact with each other. Further, a belt cleaning apparatus 9 serving as an intermediate transfer member cleaning unit is disposed on the external circumferential surface side of the intermediate transfer belt 7 at a position where the belt cleaning apparatus 9 can face the driving roller 71.

The photosensitive drum 1 can be uniformly charged by the charging roller 2 while the photosensitive drum 1 is rotating around a rotational axis thereof. The charged photosensitive drum 1 can be exposed by the exposure apparatus 3 according to image information. An electrostatic latent image (i.e., an electrostatic image) can be formed on the photosensitive drum 1 according to the image information. Color toner particles corresponding to each image forming unit S can be supplied from the developing apparatus 4 to the electrostatic latent image formed on the photosensitive drum 1 to develop a toner image. The toner image developed on the photosensitive drum 1 can be transferred (i.e., primarily transferred) onto the rotating intermediate transfer belt 7 at the primary transfer portion T1, by the function of the primary transfer roller 5. In this case, a primary transfer bias (i.e., a primary transfer voltage), which is a direct current (DC) voltage having a polarity opposed to the toner charging polarity (i.e., regular charging polarity) in a developing operation, is applied to the primary transfer roller 5 from a primary transfer power source 51 that serves as a voltage applying unit. Therefore, a primary transfer electric field can be formed at the primary transfer portion T1. In the present exemplary embodiment, primary transfer power sources 51Y, 51M, 51C, and 51K are connected to the corresponding primary transfer rollers 5Y, 5M, 5C, and 5K of the image forming units SY, SM, SC, and SK. For example, in a full-color image forming operation, respective image forming units S form yellow, magenta, cyan, and black toner images. The formed toner images are sequentially transferred onto the intermediate transfer belt 7 at their primary transfer portions T1 in such a manner that the transferred toner images are overlapped one on another.

Subsequently, the toner images transferred on the intermediate transfer belt 7 are transferred (i.e., secondarily transferred) onto a transfer member P, at the secondary transfer portion T2, by the function of the secondary transfer roller 8. In this case, a secondary transfer bias (i.e., a secondary transfer voltage), which is a direct current (DC) voltage having a polarity opposed to the toner regular charging polarity, is applied to the secondary transfer roller 8 from a secondary transfer power source 81 that serves as a voltage applying unit. Therefore, a secondary transfer electric field can be formed at the secondary transfer portion T2. Meanwhile, the transfer member (i.e., recording material) P can be fed from a paper feeding cassette 10 and once stopped by registration rollers 12. Then, the transfer member P can be conveyed to the secondary transfer portion T2 at predetermined timing. The transfer member P on which the toner images have been transferred can be subsequently conveyed to a fixing apparatus 11. The fixing apparatus 11 fixes the toner images on the transfer member P by applying heat and pressure. Subsequently, the transfer member P can be discharged (output) to the outside from the main body of the image forming apparatus 100.

Transfer residual toner particles remaining on the photosensitive drum 1 without being transferred to the intermediate transfer belt 7 in the primary transfer process can be removed from the photosensitive drum 1 and collected by the drum cleaning apparatus 6. Further, transfer residual toner particles remaining on the intermediate transfer belt 7 without being transferred to the transfer member P in the secondary transfer process can be removed from the intermediate transfer belt 7 and collected by the belt cleaning apparatus 9.

2. Configuration of Each Constituent Component 2-1. Photosensitive Drum

The photosensitive drum 1 includes an organic photoconductor layer (OPC) coated on an external circumferential surface of an aluminum cylinder. The photosensitive drum 1 is rotatably supported by flanges at both end portions thereof in a longitudinal direction (i.e., a rotational axis direction). The photosensitive drum 1 is rotatably driven by a driving motor (not illustrated) that can transmit a driving force to one end portion of the photosensitive drum 1. In the present exemplary embodiment, the charging polarity of the photosensitive drum 1 is a negative polarity.

In the present exemplary embodiment, the outer diameter of respective photosensitive drums 1Y, 1M, and 1C provided in the first, second, and third image forming units SY, SM, and SC (i.e., the image forming units dedicated to yellow, magenta, and cyan colors) is ϕ30 (mm). Hereinafter, each of the photosensitive drums 1Y, 1M, and 1C may be referred to as a "smaller-diameter photosensitive drum." On the other hand, the outer diameter of the photosensitive drum 1K provided in the fourth image forming unit SK (i.e., the image forming unit dedicated to the black color) is ϕ84 (mm). Hereinafter, the photosensitive drum 1K may be referred to as a "larger-diameter photosensitive drum." More specifically, only the black photosensitive drum 1K is greater than the yellow, magenta, and cyan photosensitive drums 1Y, 1M, and 1C.

2-2. Charging Roller

The charging roller 2 is a contact charging member that can be brought into contact with the surface of the photosensitive drum 1 and can uniformly charge the cylindrical surface of the photosensitive drum 1. The charging roller 2 is an electroconductive roller that includes a cored bar (i.e., a core material) and an elastic layer formed around the cored bar. The charging roller 2 is rotatably held by bearing members at both end portions thereof in a longitudinal direction (i.e., a rotational axis direction) thereof. The charging roller 2 is urged toward the photosensitive drum 1 by a pressing spring that serves as an urging unit. Accordingly, the charging roller 2 is pressed in touch with the surface of the photosensitive drum 1 under a predetermined pressing force and can rotate around the rotational axis thereof according to the rotation of the photosensitive drum 1. A charging power source 21 (see FIG. 4), which serves as a voltage applying unit, applies a predetermined charging bias (i.e., a charging voltage) to the cored bar of the charging roller 2. Accordingly, while the photosensitive drum 1 is rotating around the rotational axis thereof, the cylindrical surface of the photosensitive drum 1 can be charged to have a predetermined potential of predetermined polarity (i.e., the negative polarity in the present exemplary embodiment). In the present exemplary embodiment, the charging bias is a vibration voltage that is composed of a direct current (DC) voltage Vdc and an alternating current (AC) voltage Vac. More specifically, the charging bias (the vibration voltage) is a summation of a DC voltage of −600V (i.e., DC component) and a sine-wave AC voltage having a frequency f of 1 kHz and a peak-to-peak voltage Vpp of 1.5 kV (i.e., AC component). Accordingly, the cylindrical surface of the photosensitive drum 1 can be uniformly charged to have an electric potential of −600V (i.e., a dark potential Vd).

2-3. Exposure Apparatus

The exposure apparatus 3 is a laser scanner apparatus that includes a laser light source and a polygon mirror. A driving circuit can perform an illumination control for the exposure apparatus 3 according to an image signal. The exposure apparatus 3 can irradiate the photosensitive drum 1 with a laser beam via the polygon mirror according to the image signal that corresponds to an original document component color of each image forming unit S.

2-4. Developing Apparatus

The developing apparatus 4 uses a two-component developing agent that includes nonmagnetic toner particles and magnetic carriers. In the present exemplary embodiment, the toner has negative charging characteristics. The developing apparatus 4 includes a developing container that stores the developing agent. Further, the developing apparatus 4 includes a developing sleeve that serves as a developing agent carrier. The developing sleeve is provided in such a way as to be partly exposed from an aperture portion of the developing container and face the photosensitive drum 1. The developing sleeve is disposed adjacently to the surface of the photosensitive drum 1. A driving motor (not illustrated) serving as a driving unit can rotate and drive the developing sleeve. A developing power source (not illustrated) serving as a voltage applying unit can apply a predetermined developing bias (i.e., a developing voltage) to the developing sleeve. Accordingly, the toner can be supplied from the developing agent carried by the developing sleeve and conveyed to an opposing position (i.e., a developing portion) of the photosensitive drum 1. The electrostatic latent image on the photosensitive drum 1 can be developed as a toner image. In the present exemplary embodiment, when the developing apparatus 4 forms a toner image, toner particles having the polarity identical to the charging polarity of the photosensitive drum 1 are caused to adhere to an exposure portion of the photosensitive drum 1 in a state where the absolute value of the potential is reduced after the photosensitive drum 1 has been uniformly charged. The above-mentioned phenomenon is referred to as reversal phenomenon. The toner includes an external additive that can enhance toner releasability.

2-5. Primary Transfer Roller

The primary transfer roller 5 is an electroconductive roller that includes a cored bar (i.e., a core material) and an elastic layer formed around the cored bar. The cored bar is a columnar member made of an electroconductive metal having a diameter of 8 mm. The elastic layer is an electroconductive foamed member having a resistance value of $1.0\times10^4$ to $5.0\times10^6$ [Ω] and a thickness of 0.5 mm. The elastic layer covers an outer cylindrical surface of the cored bar. Further, the primary transfer roller 5 is 300 g in weight. In the present exemplary embodiment, the primary transfer roller 5 in each image forming unit S is configured to have the same outer diameter.

The primary transfer roller 5 is supported by a pressing mechanism. The pressing mechanism causes the primary transfer roller 5 to contact the photosensitive drum 1 from the back surface side of the intermediate transfer belt 7, in such a way as to transfer the toner image from the photosensitive drum 1 to the intermediate transfer belt 7 by the electric function and the pressing force. In the present exemplary embodiment, the primary transfer roller 5 has two end portions in the longitudinal direction (i.e., the rotational axis direction) thereof. Two pressing springs provided at the end portions press the primary transfer roller 5 upward. In this respect, each pressing spring serves as an urging unit.

Figure 5:
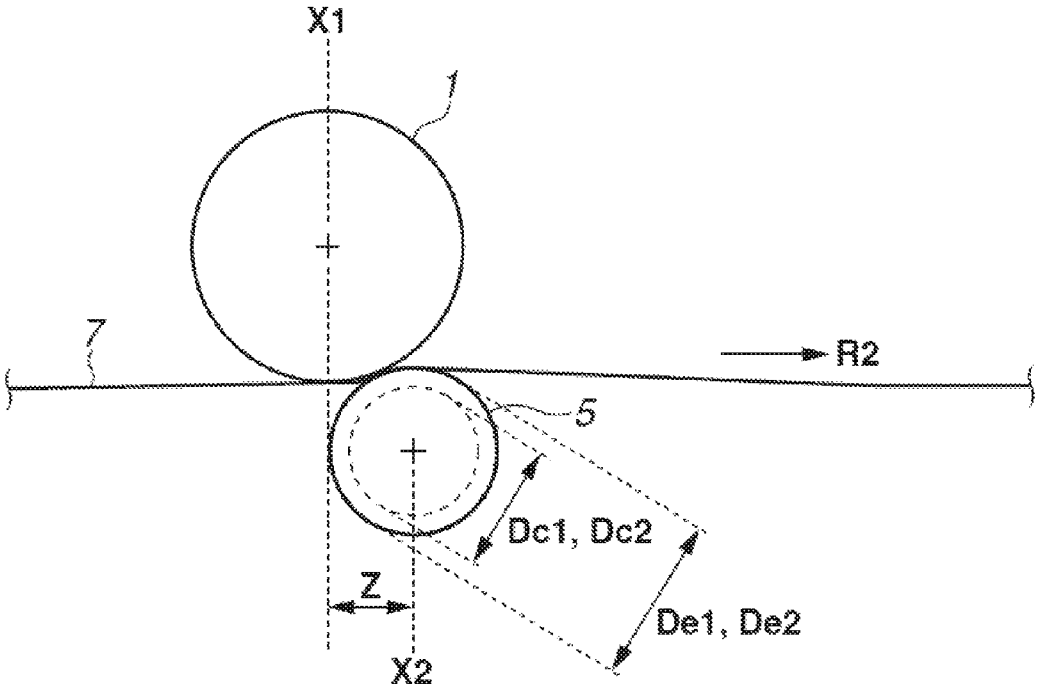
FIG. 5 is a schematic diagram illustrating a shift amount of a primary transfer roller.

The primary transfer roller 5 is disposed on a downstream side in relation to the vertical line passing through the rotation center of the photosensitive drum 1, in a conveyance direction of the intermediate transfer belt 7. In the present exemplary embodiment, a shift amount between the primary transfer roller 5 and the photosensitive drum 1 is set to be a value in a range from 1.5 mm to 5.5 mm for verification described in detail below. More specifically, as illustrated in FIG. 5, a straight line X1 passes through the rotation center of the photosensitive drum 1 and extends in a direction perpendicular to the intermediate transfer belt 7. The photosensitive drum 1 is positioned on the upstream side of the primary transfer roller 5 in the conveyance direction of the intermediate transfer belt 7. Further, a straight line X2 passing through the rotation center of the primary transfer roller 5 is parallel to the straight line X1. In this case, according to the present exemplary embodiment, a shift amount Z of the primary transfer roller 5 in relation to the photosensitive drum 1 can be represented by a shift amount of the straight line X2 in relation to the straight line X1.

A pressure measurement jig can be used to measure the pressing force of the primary transfer roller 5. For example, it is useful to prepare a pseudo metallic counter roller having a diameter equivalent to that of the photosensitive drum 1 and divided into five pieces in a rotational axis direction thereof. In this case, a load cell can be used to detect the pressure applied to the metallic counter roller to realize the measurement of the pressing force of the primary transfer roller 5. The above-mentioned measurement system can be installed in the main body of the image forming apparatus 100 and can be used to measure an actual pressure applied from the primary transfer roller 5 to the photosensitive drum 1. Further, because the metallic counter roller used in this case is composed of five divided pieces, it is possible to measure a pressure distribution in the longitudinal direction of the primary transfer roller 5. As mentioned in detail below, the force at a pressure contact portion used for comparison in the present exemplary embodiment is a value converted into a linear load per unit length (cm) in the longitudinal direction.

In the present exemplary embodiment, the image forming apparatus 100 is operable in a plurality of image forming modes, more specifically, a full-color mode (i.e., a first image forming mode) and a black monochrome mode (i.e., a second image forming mode or a monochrome image forming mode). Each one of the above-mentioned two image forming modes is different in the number of the image forming units S used in a toner image forming operation. In the full-color mode, the image forming apparatus 100 causes the first, second, third, and fourth image forming units SY, SM, SC, and SK to form toner images of respective colors that are sequentially overlapped to obtain a full-color image. In the black monochrome mode, the image forming apparatus 100 causes only the fourth image forming unit SK to form a toner image to obtain a black color image. In other words, the image forming apparatus 100 uses only one of the first, second, third, and fourth image forming units SY, SM, SC, and SK as a predetermined image forming unit that forms a monochrome image. To this end, the image forming apparatus 100 includes a belt contact/separation mechanism 170 (see FIG. 4) that can bring the photosensitive drums 1Y, 1M, and 1C of the image forming units SY, SM, and SC (i.e., the photosensitive drums that are not used in the black monochrome mode) out of contact with the intermediate transfer belt 7.

Figure 2:
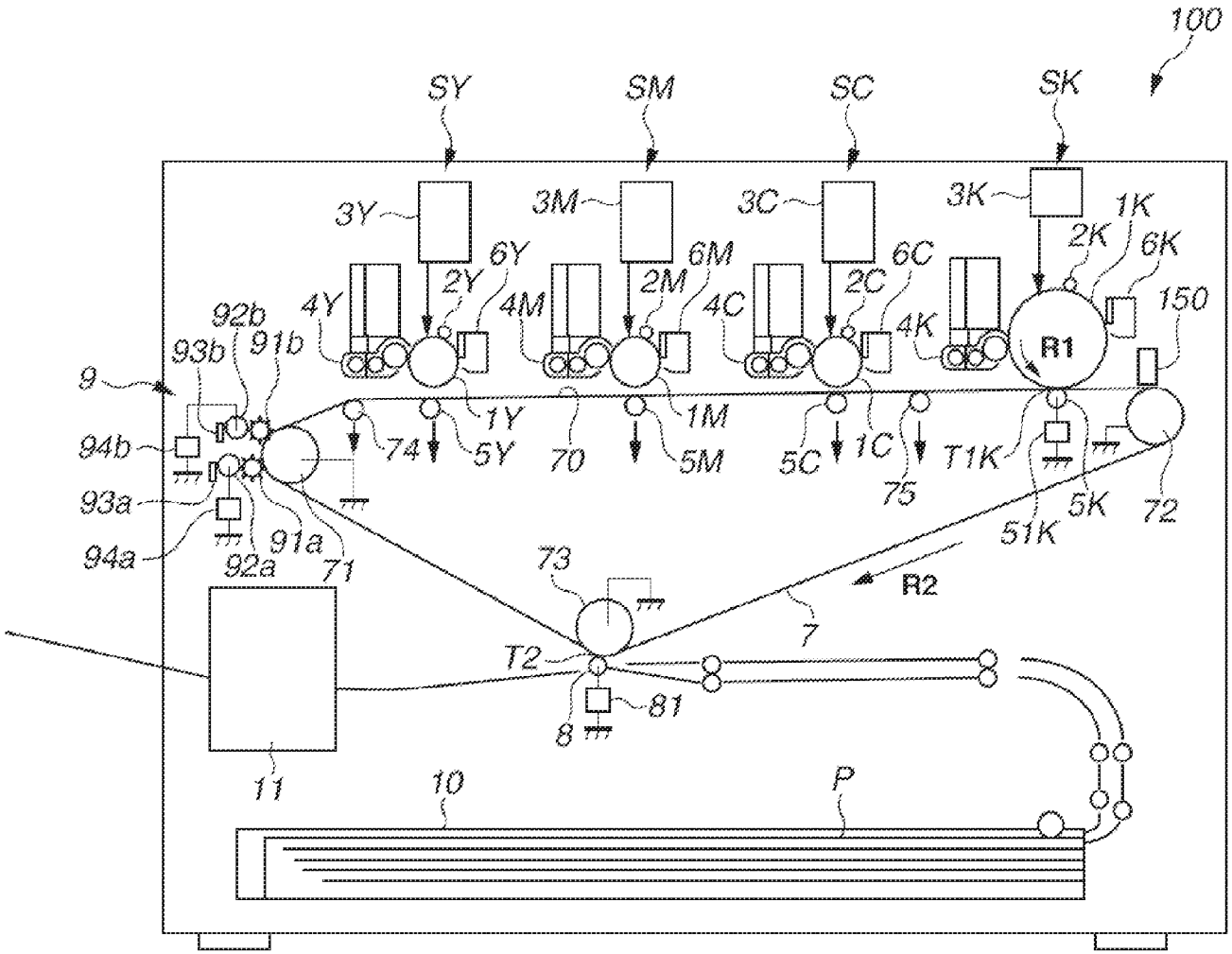
FIG. 2 is a schematic cross-sectional view of the image forming apparatus in a black monochrome mode.

In the present exemplary embodiment, the primary transfer plane 70 is moved by the push-up rollers 74 and 75 and the primary transfer rollers 5Y, 5M, and 5C of the first, second, and third image forming units SY, SM, and SC moving in the up-and-down direction as illustrated in FIG. 2. In the full-color mode, the primary transfer plane 70 can be formed by the push-up rollers 74 and 75 and the tension roller 72. In the black monochrome mode, the primary transfer plane 70 can be formed by the push-up roller 75 (i.e., the push-up roller positioned on the downstream side in the conveyance direction of the intermediate transfer belt 7) and the tension roller 72. Accordingly, in the full-color mode, the photosensitive drums 1Y, 1M, 1C, and 1K of the first, second, third, and fourth image forming units SY, SM, SC, and SK can contact the intermediate transfer belt 7. On the other hand, in the black monochrome mode, the photosensitive drums 1Y, 1M, and 1C of the first, second, and third image forming units SY, SM, and SC can be separated from the intermediate transfer belt 7. As mentioned above, the present exemplary embodiment employs the configuration capable of selectively switching the positions of the primary transfer rollers 5Y, 5M, and 5C of the first, second, and third image forming units SY, SM, and SC between the black monochrome mode and the full-color mode. The members constituting the belt contact/separation mechanism 170 includes the push-up rollers 74 and 75, support members that support the primary transfer rollers 5Y, 5M, and 5C of the first, second, and third image forming units SY, SM, and SC, and a switching unit configured to cause the above-mentioned rollers to move via the support members. The switching unit employed in the present exemplary embodiment is a solenoid. The switching unit causes each of the above-mentioned rollers to selectively move in the up-and-down direction between a first position at which the intermediate transfer belt 7 is located closely to the photosensitive drum and a second position at which the intermediate transfer belt 7 is located away from the photosensitive drum 1. In the present exemplary embodiment, the photosensitive drums 1Y, 1M, and 1C of the first, second, and third image forming units SY, SM, and SC (i.e., the photosensitive drums that are not used in the black monochrome mode) can be separated from the intermediate transfer belt 7. Therefore, the lifetime of these photosensitive drums 1Y, 1M, and 1C can be extended. Further, life prolongation of the photosensitive drum 1K of the fourth image forming unit SK (i.e., the image forming unit frequently used) can be achieved by enlarging the diameter of the black photosensitive drum 1K.

In the present exemplary embodiment, the primary transfer bias can be determined by a conventionally known Active Transfer Voltage Control (ATVC control), as discussed in Japanese Patent Application Laid-Open No. 2-123385. More specifically, a desired constant-current voltage is applied to the primary transfer roller when the image forming apparatus does not perform any image forming operation and the applied voltage value is held. Then, a primary transfer voltage (i.e., a constant-voltage corresponding to the above-mentioned voltage value) is applied to the primary transfer roller 5 during the primary transfer process in the image forming operation. An optimum current can be obtained beforehand for the primary transfer current in the constant-current voltage application when the image forming apparatus does not perform any image forming operation. The obtained optimum current is set as a target current to determine the transfer electric field at the primary transfer portion T1.

2-6. Intermediate Transfer Belt

Figure 6:
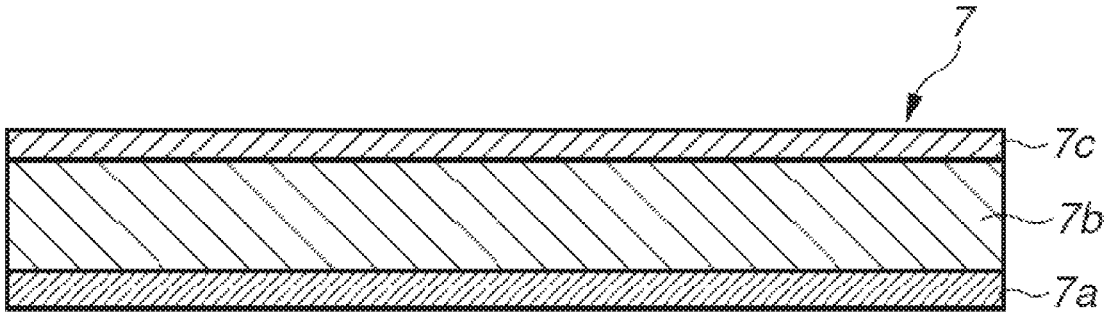
FIG. 6 is a schematic cross-sectional view illustrating a layer configuration of an intermediate transfer belt.

The intermediate transfer belt 7 employed in the present exemplary embodiment is a belt that is constituted by a plurality of layers including an elastic layer. In this respect, the intermediate transfer belt 7 may be referred to as "elastic intermediate transfer belt." FIG. 6 is a schematic cross-sectional view illustrating a layer configuration of an example of the elastic intermediate transfer belt 7. In the present exemplary embodiment, the elastic intermediate transfer belt 7 has a three-layer structure including a base layer (e.g., a resin layer) 7*a*, an elastic layer 7*b*, and a surface layer 7*c*. To maintain adequate image property, the elastic intermediate transfer belt 7 according to the present exemplary embodiment has a three-layer surface resistance rate of $10^{12}\Omega/\square$ and a volumetric resistance rate of $10^{9}$ Ω·cm. A high-resistivity meter (e.g., Hiresta-UPM, CP-HT450, or UR prove provided by Mitsubishi Chemical Corporation) can be used to measure the resistance rate. As measurement conditions, the application voltage has been set to 1000 V and the application time has been set to 10 seconds. Further, it is desired that respective layers of the elastic intermediate transfer belt 7 have appropriate dimensions. More specifically, the base layer 7*a* has a film thickness of 50 μm to 100 μm. The elastic layer 7*b* has a film thickness of 200 μm to 300 μm. And, the surface layer 7*c* has a film thickness of approximately 2 μm to 20 μm. In the present exemplary embodiment, the film thickness of the base layer 7*a* is set to 85 μm. The film thickness of the elastic layer 7*b* is set to 260 μm. The film thickness of the surface layer 7*c* is set to 2 μm. Further, it is desired that the elastic intermediate transfer belt 7 has an IRHD hardness of 40 to 90 as a three-layer surface hardness. In the present exemplary embodiment, the IRHD hardness of the elastic intermediate transfer belt 7 is set to 73±3.

The base layer 7*a* and the elastic layer 7*b* can be made of any material that can satisfy the above-mentioned characteristics. As representative examples, a polycarbonate film, a fluorine-based resin film (ethylene tetrafluoroethylene (ETFE) film or polyvinylidene fluoride (PVDF) film), a polyamide resin film, or a polyimide resin film, if it has a Young's modulus (JISK7127) of $5.0\times10^{2}$ MPa to $5.0\times10^{3}$ MPa, can be used as a resin material that constitutes the base layer (i.e., the resin layer) 7*a*. Further, a butyl rubber, a fluorine rubber, a CR rubber, an ethylene propylene diene monomer (EPDM) rubber, or a urethane rubber, if it has a Young's modulus of 0.1 MPa to $1.0\times10^{2}$ MPa, can be used as an elastic material (e.g., an elastic rubber or an elastomer) that constitutes the elastic layer 7*b*. Further, the surface layer 7*c* is not limited to a specific material. However, employing a material capable of reducing an attractive force of toner particles adhering to the surface of the intermediate transfer belt 7 and enhancing secondary transfer property is desired. For example, a resin material (e.g., a fluorine-based resin or a fluorine compound), a urethane-based resin containing scattered fluorine-based resin particulates, or an elastic material, if it has a Young's modulus of $1.0\times10^{2}$ to $5.0\times10^{3}$ MPa, is employable. However, the base layer 7*a*, the elastic layer 7*b*, and the surface layer 7*c* are not limited to the above-mentioned materials. As mentioned above, in the present exemplary embodiment, the intermediate transfer member is constituted by a plurality of layers. The hardness of a layer positioned on the toner image carrying surface side is lower than the hardness of a layer positioned on the toner image non-carrying surface side (i.e., the lowermost layer).

The intermediate transfer belt 7 employed in the present exemplary embodiment is the above-mentioned elastic intermediate transfer belt. However, a single-layer belt (e.g., a resin belt) can also be used as the intermediate transfer belt 7.

2-7. Secondary Transfer Roller

The secondary transfer roller 8 is an electroconductive roller that includes a cored bar (i.e., a core material) and an elastic layer made of an ionic conducting foaming rubber (e.g., a nitrile rubber (NBR)) and formed around the cored bar. The secondary transfer roller 8 has an outer diameter of 24 mm and a roller surface roughness (Rz) of 6.0 μm to 12.0 μm. Further, the secondary transfer roller 8 has a resistance value of $1.0\times10^5\Omega$ to $1.0\times10^8\Omega$ under application of 2 kV in the N/N (23° C., 50% RH) measurement.

In the present exemplary embodiment, the image forming apparatus 100 includes a secondary transfer roller contact/separation mechanism 180 (see FIG. 4) that can bring the secondary transfer roller 8 into or out of contact with the intermediate transfer belt 7. Accordingly, the secondary transfer roller 8 is selectively switchable between an operational state where the secondary transfer roller 8 can contact the intermediate transfer belt 7 and rotate around a rotational axis thereof according to the rotation of the intermediate transfer belt 7 and a non-operational state where the secondary transfer roller 8 can be separated from the intermediate transfer belt 7. The secondary transfer roller contact/separation mechanism 180 includes a support member that supports the secondary transfer roller 8 and a switching unit configured to cause the secondary transfer roller to move via the support member. The switching unit employed in the present exemplary embodiment is a solenoid. The switching unit selectively causes the secondary transfer roller 8 to move in the up-and-down direction between a first position at which the secondary transfer roller 8 contacts the intermediate transfer belt 7 and a second position at which the secondary transfer roller 8 separates from the intermediate transfer belt 7. In the present exemplary embodiment, the secondary transfer roller 8 is separated from the intermediate transfer belt 7 when a patch (i.e., a toner image dedicated to adjustment) formed on the intermediate transfer belt 7 passes by the secondary transfer portion T2 in an image density adjustment operation. The above-mentioned patch can be detected by a patch sensor 150 that serves as a detection unit.

2-8. Belt Cleaning Apparatus (i.e., Electrostatic Fur Brush Cleaning)

Figure 3:
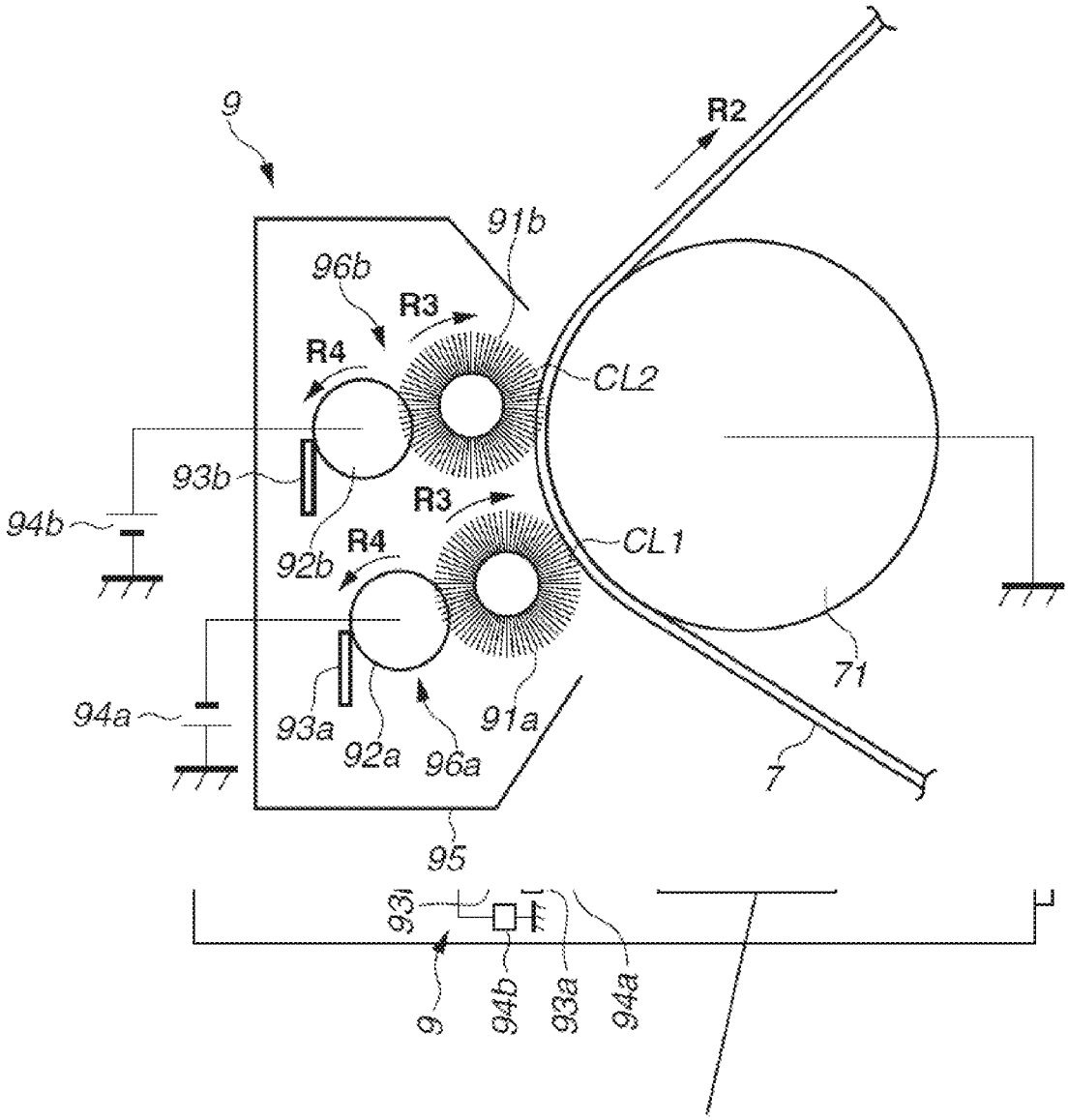
FIG. 3 is a schematic cross-sectional view illustrating a belt cleaning apparatus.

The intermediate transfer member cleaning unit employed in the present exemplary embodiment is the belt cleaning apparatus 9 capable of electrostatically removing toner particles. FIG. 3 is a cross-sectional view illustrating a schematic example of the belt cleaning apparatus 9 according to the present exemplary embodiment. The belt cleaning apparatus 9 is disposed on an upstream side of the primary transfer portion T1 (more specifically, the upstream-most primary transfer portion T1Y) and a downstream side of the secondary transfer portion T2 in the conveyance direction of the intermediate transfer belt 7.

The cleaning unit employable in the present exemplary embodiment is not limited to the above-mentioned electrostatic cleaning unit. For example, a cleaning blade type is employable because a cleaning blade (i.e., a platy cleaning member made of an elastic member) can adequately contact the intermediate transfer belt 7.

3. Control System

Figure 4:
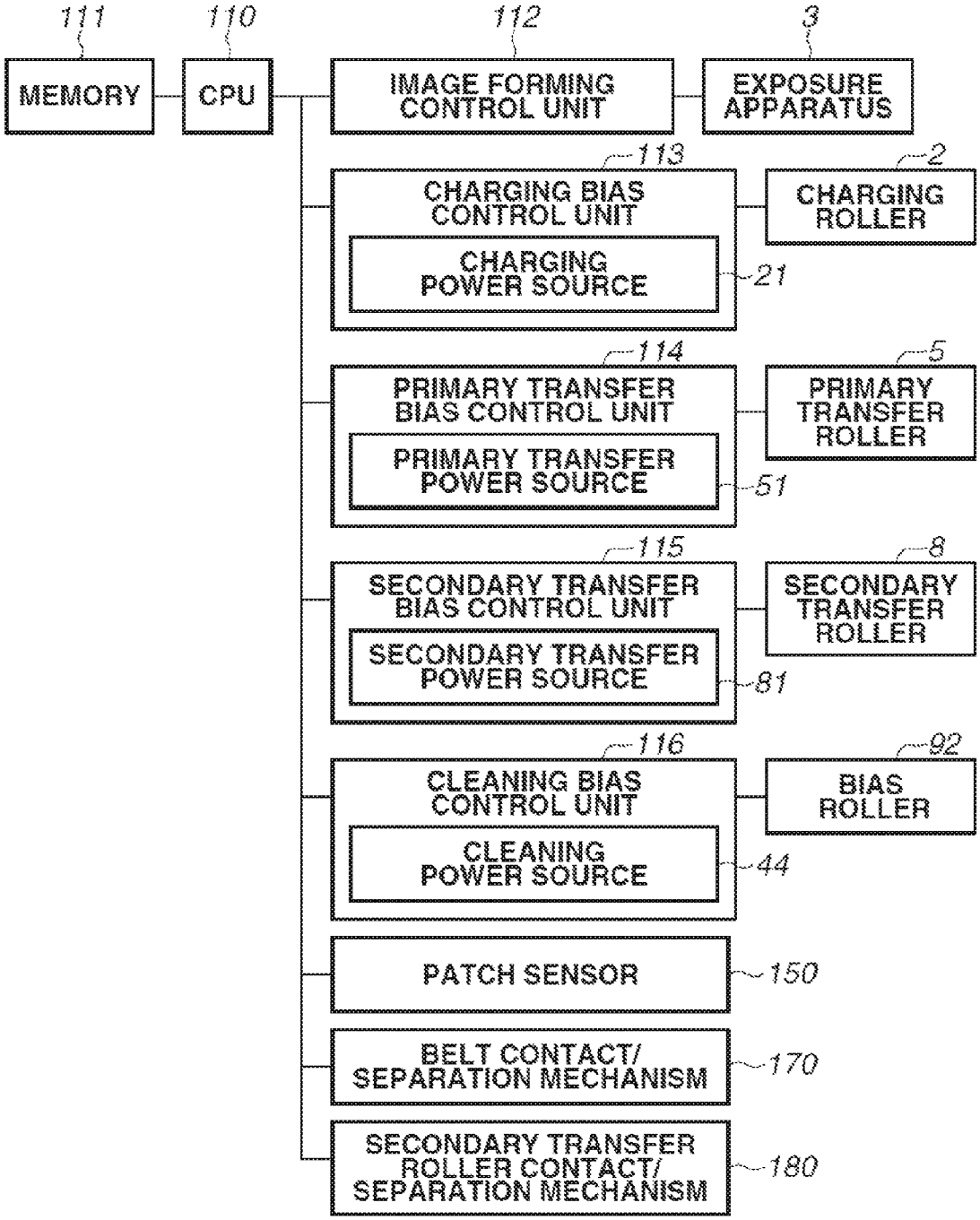
FIG. 4 is a control block diagram illustrating an essential part of the image forming apparatus.

FIG. 4 illustrates a schematic control system for an essential part of the image forming apparatus 100 according to the present exemplary embodiment. The image forming apparatus 100 includes a central processing unit (CPU) 110 that serves as a control unit configured to control various operations to be performed by the image forming apparatus 100. The image forming apparatus 100 further includes a memory 111, such as a read only memory (ROM) and a random access memory (RAM), which serves as a storage unit. For example, sensor detection results and calculation results can be stored in the RAM. Control programs and data tables obtained beforehand can be stored in the ROM. In the present exemplary embodiment, the CPU 110 can control an image forming control unit 112, a charging bias control unit 113, a primary transfer bias control unit 114, a secondary transfer bias control unit 115, and a cleaning bias control unit 116. Further, the CPU 110 can control the patch sensor 150, the belt contact/separation mechanism 170, and the secondary transfer roller contact/separation mechanism 180.

The image forming control unit 112 can control the exposure timing of the exposure apparatus 3. The charging bias control unit 113 can cause the charging power source 21 to output a constant-voltage-controlled voltage to the charging roller 2. More specifically, the charging bias control unit 113 includes a voltage detection unit configured to detect an output voltage value and performs constant-voltage control based on a setting voltage value under the control of the CPU 110. Further, the primary transfer bias control unit 114 can cause the primary transfer power source 51 to output a constant-current-controlled voltage and a constant-voltage-controlled voltage to the primary transfer roller 5. More specifically, the primary transfer bias control unit 114 includes a current detection unit configured to detect a current value when the voltage is applied to the primary transfer roller 5 and a voltage detection unit configured to detect an output voltage value. By referring to the detection results having been fed back, the CPU 110 can perform constant-current control and constant-voltage control for the bias to be applied to the primary transfer roller 5. The secondary transfer bias control unit 115 is similar to the primary transfer bias control unit 114.

4. Shift Amount and Pressing Force of Primary Transfer Roller

Next, the shift amount and the pressing force of the primary transfer roller 5 at the primary transfer portion T will be described in detail below.

In the present exemplary embodiment, the image forming apparatus 100 is a tandem-type image forming apparatus that includes a plurality of image forming units S and includes a plurality of types of photosensitive drums 1 that are differentiated in outer diameter. As mentioned above, in the present exemplary embodiment, the outer diameter of the photosensitive drums 1Y, 1M, and 1C provided in the yellow, magenta, and cyan image forming units SY, SM, and SC is ϕ30 (mm). On the other hand, the outer diameter of the photosensitive drum 1K provided in the black image forming unit SK is ϕ84 (mm). In this respect, each of the photosensitive drums 1Y, 1M, and 1C is referred to as the smaller-diameter photosensitive drum. The photosensitive drum 1K is referred to as the larger-diameter photosensitive drum. More specifically, the photosensitive drum 1K of the black image forming unit SK is greater than the yellow, magenta, and cyan photosensitive drums 1Y, 1M, and 1C.

However, the image forming unit that uses the larger-diameter photosensitive drum is not limited to the black image forming unit or is not limited to the image forming unit disposed at a downstream-most end in the conveyance direction of the intermediate transfer belt. Further, the image forming unit that uses the larger-diameter photosensitive drum is not limited to only one (e.g., the black image forming unit). Therefore, two or more image forming units can be set to use photosensitive drums that are larger in outer diameter compared to the remaining image forming units. In this case, the photosensitive drums of the above-mentioned two or more image forming units may be the same or different in outer diameter.

In the configuration according to the present exemplary embodiment, it has been confirmed that behaviors of the yellow, magenta, and cyan image forming units SY, SM, and SC are substantially similar to one another. Therefore, results obtained by the cyan image forming unit SC can be regarded as representing the image forming unit S using the smaller-diameter photosensitive drum 1. On the other hand, results obtained by the black image forming unit SK can be regarded as representing the image forming unit S using the larger-diameter photosensitive drum 1. The above-mentioned results are used in the comparison between the smaller-diameter photosensitive drum 1 and the larger-diameter photosensitive drum 1.

In the present exemplary embodiment, experiments have been conducted to study the magnitude of transfer latitude (i.e., transfer/re-transfer latitude) and the presence of the above-mentioned uneven image for each of the black solid image and the green solid image, while changing values of the shift amount of the primary transfer roller 5 and the pressing force (i.e., the linear load) of the primary transfer roller 5.

Figure 7:
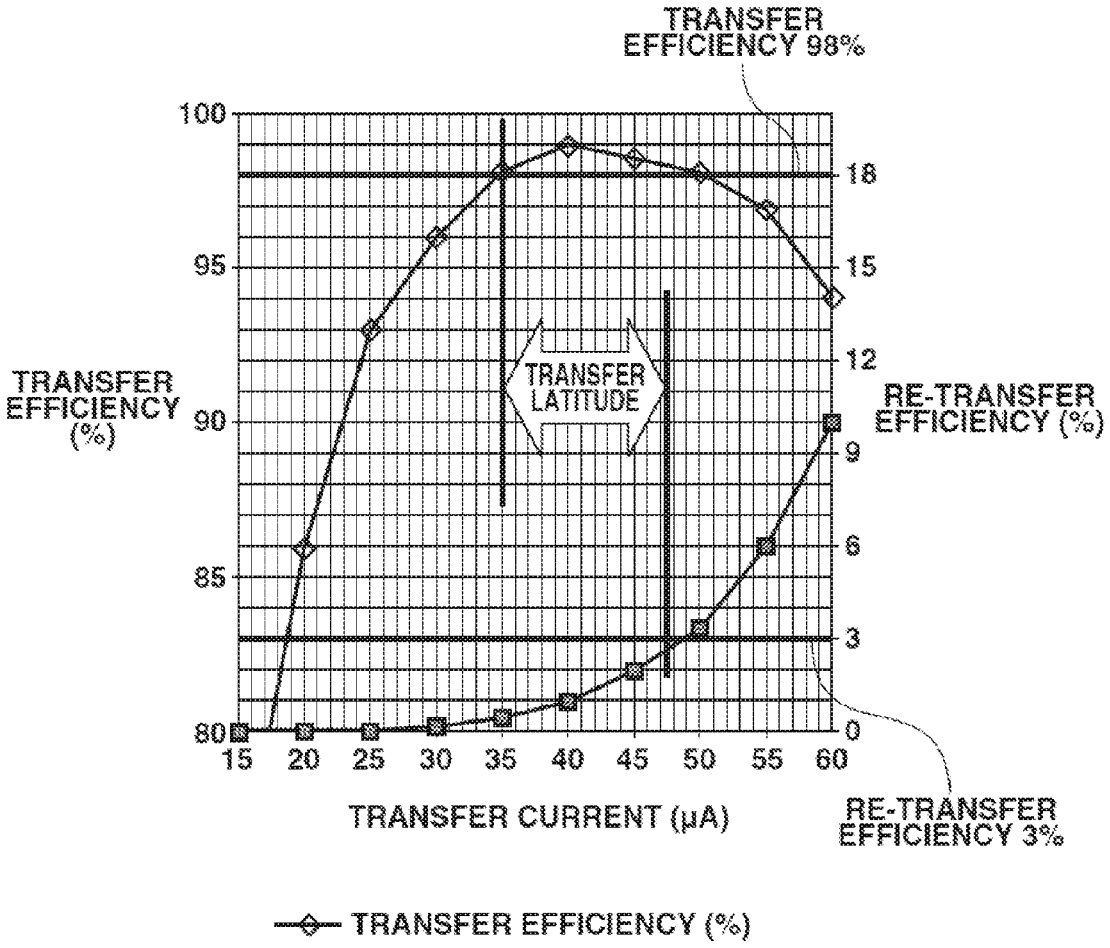
FIG. 7 is a graph illustrating an example of transfer latitude.

Hereinafter, the transfer latitude will be described with reference to FIG. 7. FIG. 7 is a graph illustrating the transfer/re-transfer efficiency at the primary transfer portion T1. The graph represents the primary transfer current (transfer current) on the horizontal axis and also represents both the transfer efficiency and the re-transfer efficiency on the vertical axis. In the present exemplary embodiment, the transfer latitude indicates the width of transfer current values that satisfy the conditions that the transfer efficiency is equal to or greater than 98% and the re-transfer efficiency is equal to or less than 3%. The transfer efficiency is a transfer rate at the primary transfer portion T1 when the toner developed on the photosensitive drum 1 is represented by 100%, which can be obtained by dividing a post-transfer toner amount by a pre-transfer toner amount. Further, the re-transfer efficiency can be obtained by dividing the re-transfer toner amount on the photosensitive drum 1 by the toner amount on the intermediate transfer belt 7 before the photosensitive drum 1 passes by. In general, because of largeness of toner amount, the re-transfer of a secondary color solid image is largest. Therefore, a red image has been referred to in calculating the above-mentioned efficiency for the cyan image forming unit SC and a blue image has been referred to in calculating the above-mentioned efficiency for the black image forming unit SK.

It is understood from the graph illustrated in FIG. 7 that the transfer efficiency equal to or greater than 98% can be attained when the primary transfer current is in a range from 34.8 μA to 50 μA. It is further understood that the re-transfer efficiency equal to or less than 3% can be obtained when the primary transfer current is in a range from 0 μA to 48.5 μA. The primary transfer current values of 34.8 μA to 48.5 μA can satisfy the above-mentioned two conditions. Therefore, the transfer latitude in this case is equal to 13.7 μA. Further, a target value of the primary transfer current in the image forming operation is set to 41.7 μA, which is equal to a central value of the calculated transfer latitude. Confirmation of the above-described uneven image has been made by setting the primary transfer current to the above-mentioned central value.

Figure 8A:
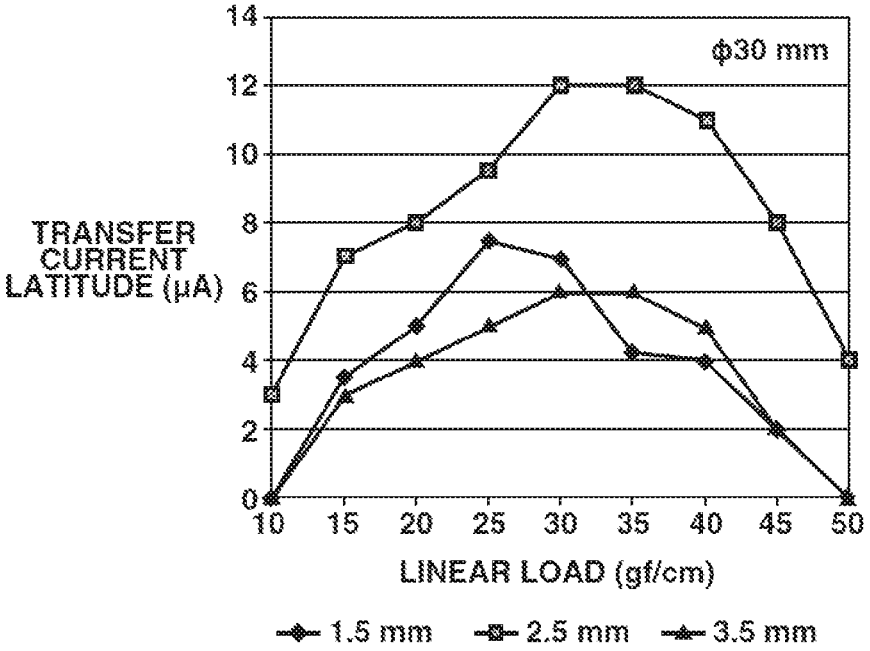
FIGS. 8A and 8B are graphs each illustrating preferred effects brought by an exemplary embodiment.
Figure 8B:
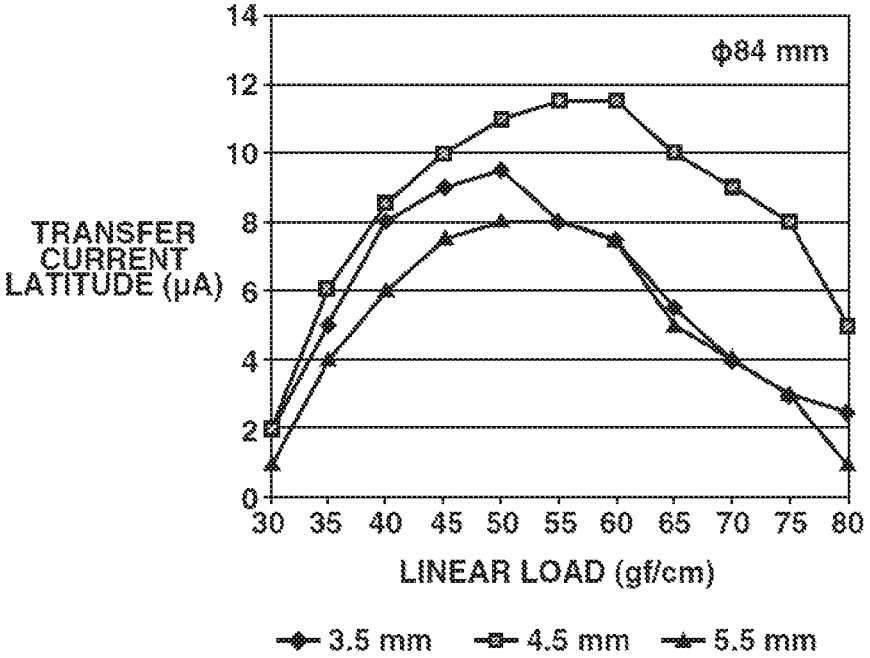

In testing the transfer latitude, the shift amount of the primary transfer roller 5 in relation to the smaller-diameter (ϕ30 mm) photosensitive drum 1 has been set to 1.5 mm, 2.5 mm, and 3.5 mm. Further, the linear load has been set to a value in a range from 10 gf/cm to 50 gf/cm. The primary transfer current has been set to a value in a range of 10 μA to 60 μA. Further, in testing the transfer latitude, the shift amount of the primary transfer roller 5 in relation to the larger-diameter (ϕ84 mm) photosensitive drum 1 has been set to 3.5 mm, 4.5 mm, and 5.5 mm. Further, the linear load has been set to a value in a range from 30 gf/cm to 80 gf/cm. The primary transfer current has been set to a value in a range from 10 μA to 60 μA. FIGS. 8A and 8B illustrate experimental data obtained as results of the above-mentioned tests. The test results reveal that the shift amount being set to 2.5 mm and the linear load being in a range from 30 gf/cm to 40 gf/cm are optimum conditions for the smaller-diameter photosensitive drum 1. On the other hand, it has been confirmed that the shift amount being set to 4.5 mm and the linear load being in a range from 50 gf/cm to 60 gf/cm are optimum conditions for the larger-diameter photosensitive drum 1.

Further, it has been confirmed that if the shift amount and the linear load are deviated from the above-mentioned optimum values, the above-mentioned image defectiveness tends to occur due to abnormal discharge. In a case where the shift amounts of the smaller-diameter photosensitive drum 1 and the larger-diameter photosensitive drum 1 are smaller than the above-mentioned optimum shift amount, the abnormal discharge increases on the upstream of the primary transfer portion T1. It can be considered that the transfer latitude becomes narrower because the charging polarity of a toner image formed on the photosensitive drum 1 is reversed and the amount of toner particles that can be transferred to the intermediate transfer belt 7 at the primary transfer portion T1 decreases. Further, the pre-transfer (i.e., the phenomenon that the toner image is transferred to the intermediate transfer belt 7 on the upstream side of the primary transfer portion T1 before the toner image on the photosensitive drum 1 enters the nip portion) occurs frequently. Therefore, the amount of a toner scattering image has increased. Further, the abnormal discharge increases on the downstream side of the primary transfer portion T1. The occurrence frequency of the above-mentioned image defectiveness due to abnormal discharge becomes higher, in particular, in the larger-diameter photosensitive drum 1.

On the other hand, in a case where the shift amount is excessively large, forming a stable nip is difficult because the width of the nip portion between the photosensitive drum 1 and the intermediate transfer belt 7 becomes smaller. As a result, the discharge amount increases in the nip portion. It can be considered that the transfer latitude becomes narrower because the amount of re-transfer (i.e., the phenomenon that the toner charging polarity is reversed and the toner particles return to the photosensitive drum 1) increases. Further, because a stable nip is not obtained, the occurrence frequency of the above-mentioned uneven image becomes higher.

Even in a case where the shift amount is set to the above-mentioned optimum value, it is difficult to obtain a stable nip if the linear load is small. Therefore, a phenomenon similar to that described above has occurred. More specifically, the re-transfer has increased and the uneven image has occurred at a higher frequency. On the other hand, in a case where the linear load is excessively large, a nip force acting on the toner tends to become greater and toner particles may stick together. In other words, the cohesion becomes higher. The adhesive force of the toner to the intermediate transfer belt 7 may increase. As a result, the toner cannot easily separate from the intermediate transfer belt 7 at the secondary transfer portion T2. Therefore, a phenomenon that the transfer efficiency decreases at the secondary transfer portion T2 may newly occur.

Further, the following is believed to be the reason why the primary transfer portion T1 of the larger-diameter photosensitive drum 1 requires a significant linear load compared to that of the smaller-diameter photosensitive drum 1. More specifically, if the curvature of the photosensitive drum 1 is changed, the stretch angle of the intermediate transfer belt 7 varies on both the upstream and downstream sides of the primary transfer portion T1. The distance from the photosensitive drum 1 to the intermediate transfer belt 7 varies correspondingly. Therefore, the discharge state is changed. As mentioned above, the abnormal discharge tends to occur on the larger-diameter photosensitive drum 1. In particular, in a case where the intermediate transfer belt 7 is made of an elastic intermediate transfer belt, the winding state of the intermediate transfer belt 7 around the photosensitive drum 1 changes as described above. Therefore, it is necessary that the linear load of the larger-diameter photosensitive drum 1 is set to be greater than the linear load of the smaller-diameter photosensitive drum at the primary transfer portion T1.

Figure 9:
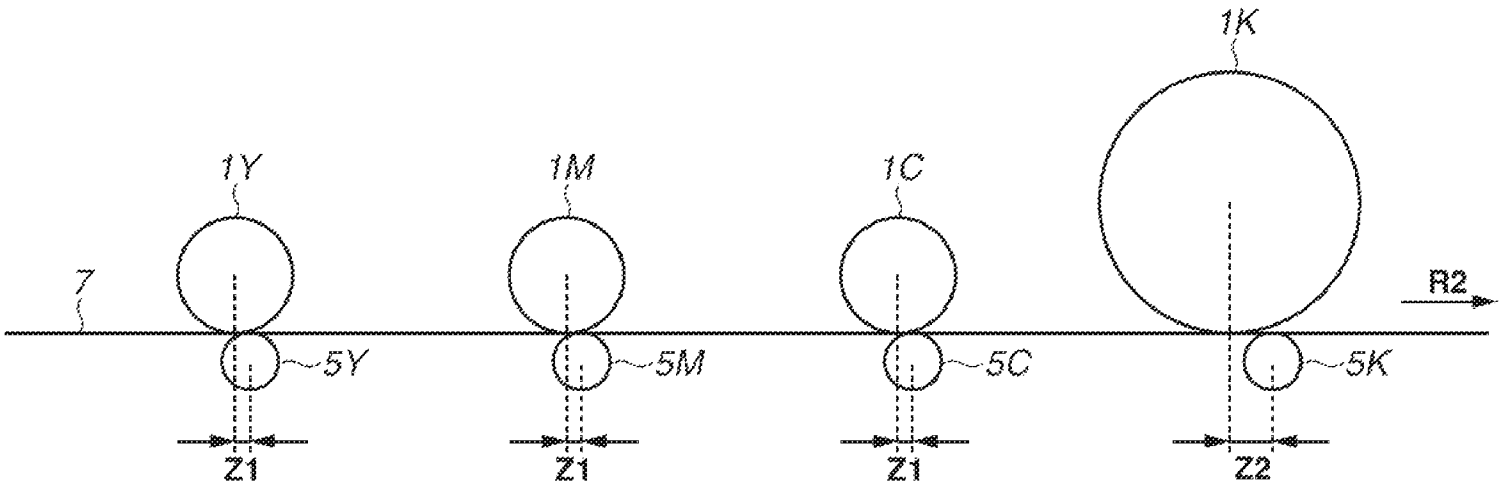
FIG. 9 illustrates a center to center distance between photosensitive drums and primary transfer rollers.

As mentioned above, the image forming apparatus 100 according to the present exemplary embodiment includes first photosensitive members 1Y to 1C capable of forming a toner image on a drum-shaped body thereof having a first outer diameter and a second photosensitive member 1K capable of forming a toner image on a drum-shaped body having a second outer diameter that is greater than the first outer diameter. Further, the image forming apparatus 100 includes a rotatable endless intermediate transfer belt 7 on which toner images can be transferred from the first and second photosensitive members. Further, the image forming apparatus 100 according to the present exemplary embodiment includes first transfer rollers 5Y to 5C and a second transfer roller 5K that are pressed against the first and second photosensitive members via the intermediate transfer belt respectively and transfer the toner images to the intermediate transfer belt from the first and second photosensitive members when a voltage is applied. The position of the second transfer roller 5K in relation to the second photosensitive member 1K in the conveyance direction of the intermediate transfer belt 7 is set to be a downstream side in the conveyance direction of the intermediate transfer belt (FIG. 1, FIG. 9, Z2), compared to the position of the first transfer rollers 5Y to 5C in relation to the first photosensitive members 1Y to 1C in the conveyance direction of the intermediate transfer belt (FIG. 1, FIG. 9, Z1). Further, the pressing force of the second transfer roller 5K applied to the second photosensitive member 1K is greater than the pressing force of the first transfer rollers 5Y to 5C applied to the first photosensitive members 1Y to 1C. The image forming apparatus 100 according to the present exemplary embodiment includes a plurality of photosensitive members, including at least the above-mentioned first and second photosensitive members, disposed along the conveyance direction of the intermediate transfer belt 7. The second photosensitive member 1K is a downstream-most photosensitive member in the conveyance direction of the intermediate transfer belt 7.

As mentioned above, in a case where an image forming apparatus includes a plurality of photosensitive drums 1Y to 1K differentiated in outer diameter and uses an elastic intermediate transfer belt, the pressing force of the primary transfer roller 5K opposing the larger-diameter photosensitive drum 1K is set to be greater than the pressing force of the primary transfer rollers 5Y to 5C opposing the smaller-diameter photosensitive drums 1Y to 1C. Further, the shift amount of the primary transfer roller 5K opposing the larger-diameter photosensitive drum 1K is set to be greater than the shift amount of the primary transfer rollers 5Y to 5C opposing the smaller-diameter photosensitive drums 1Y to 1C. Accordingly, it is possible to widen the transfer latitude and improve the transfer property. As a result, the present exemplary embodiment brings a preferable effect of preventing the image defectiveness from occurring due to abnormal discharge.

Next, a second exemplary embodiment of the present invention will be described in detail below. An image forming apparatus according to the present exemplary embodiment is similar to that described in the first exemplary embodiment in basic configuration and operations. Accordingly, constituent components that are similar to those described in the first exemplary embodiment in functions and/or configurations are denoted by using the same reference numerals and redundant description thereof will be avoided.

The present exemplary embodiment is similar to the first exemplary embodiment in that the linear load of the primary transfer roller 5 applied to the larger-diameter photosensitive drum 1 is set to be greater than the linear load of the primary transfer roller 5 applied to the smaller-diameter photosensitive drum 1. In general, in a case where the pressing force applying portion is both end portions of the primary transfer roller 5 in the longitudinal direction, depressurization may occur at a central portion of the primary transfer roller 5 in the longitudinal direction. The present exemplary embodiment is similar to the first exemplary embodiment in that the shift amount of the primary transfer roller 5 in relation to the larger-diameter photosensitive drum 1 (FIG. 1, FIG. 9, Z2) is set to be greater than the shift amount of the primary transfer roller 5 in relation to the smaller-diameter photosensitive drum 1 (FIG. 1, FIG. 9, Z1).

Figure 10:
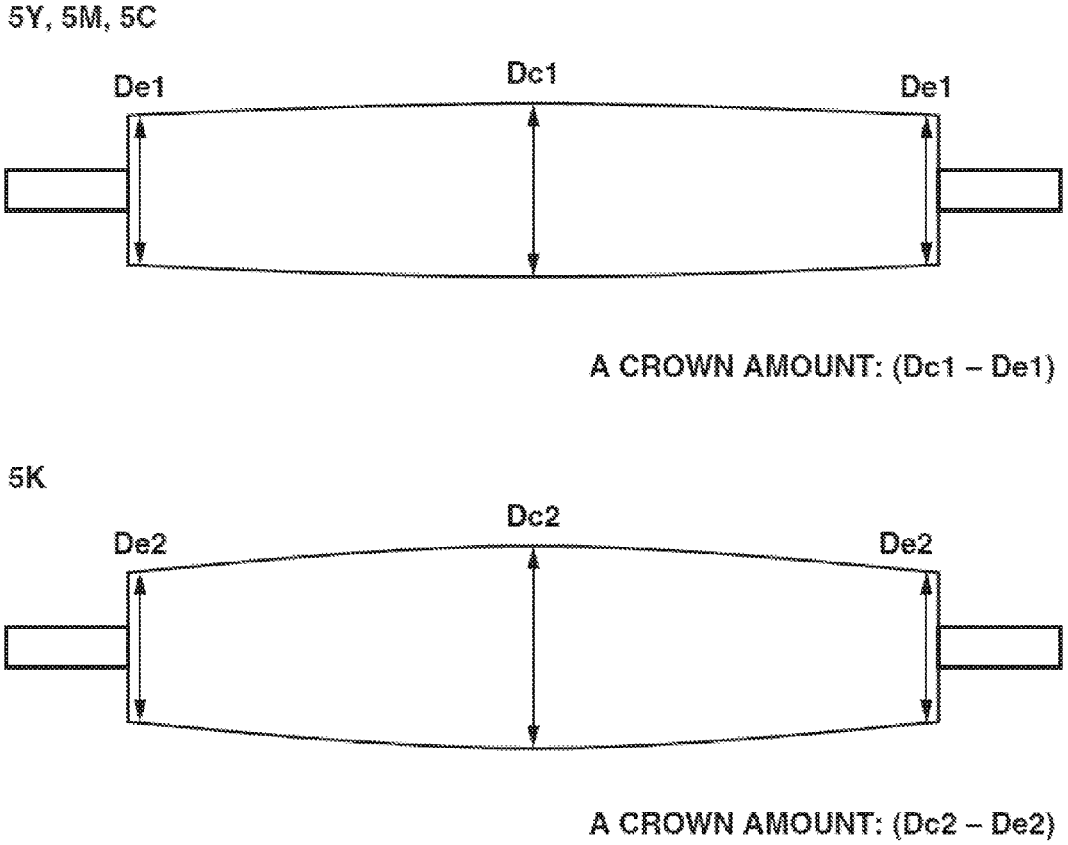
FIG. 10 illustrates a crown amount.

The primary transfer roller 5 according to the present exemplary embodiment is characterized in that a rubber portion (i.e., an elastic layer) of the primary transfer roller 5 has a crown shape that is defined by the outer diameter gradually increasing when the position shifts from the end portion to the central portion in the longitudinal direction. Further, a crown amount (FIG. 1, FIG. 10, (Dc1-De1), (Dc2-De2)) (i.e., an increased amount of the outer diameter at the central portion (Dc) compared to the outer diameter at the end portion (De) in the longitudinal direction) of the primary transfer roller 5 opposing the larger-diameter photosensitive drum 1 (Dc2-De2) is set to be greater than that of the primary transfer roller 5 opposing the smaller-diameter photosensitive drum 1 (Dc1-De1). In other words, the present exemplary embodiment provides a balanced configuration capable of uniformly applying the linear load to everywhere in the longitudinal direction of the primary transfer roller 5. As an example, it is useful that the primary transfer roller 5 opposing the smaller-diameter photosensitive drum 1 is configured to have a hyperboloidally inclined crown shape having an outer diameter of 18.01 cm at the central portion in the longitudinal direction. On the other hand, it is useful that the primary transfer roller 5 opposing the larger-diameter photosensitive drum 1 is configured to have a crown shape having an outer diameter of 18.03 cm at the central portion in the longitudinal direction.

As mentioned above, it is useful that each of the primary transfer roller 5 opposing the smaller-diameter photosensitive drum 1 and the primary transfer roller 5 opposing the larger-diameter photosensitive drum 1 has a crown shape. However, as a modified example according to the present exemplary embodiment, the primary transfer roller 5 opposing the smaller-diameter photosensitive drum 1 can be configured to have a non-crown shape. As mentioned above, in the present exemplary embodiment, at least the second transfer roller 5K has the crown shape with a crown amount greater than those of the first transfer rollers 5Y to 5C.

Accordingly, the present exemplary embodiment provides the balanced configuration capable of uniformly adjusting the stretch angle of the intermediate transfer belt 7 at the primary transfer portion T1 in the longitudinal direction of the primary transfer roller 5, even in a case where the image forming unit S uses the larger-diameter photosensitive drum 1. As a result, the present exemplary embodiment brings a preferable effect of stabilizing the state of discharge caused by the electric field at the primary transfer portion T1. Further, the present exemplary embodiment brings a preferable effect of realizing adequate transfer everywhere in the longitudinal direction of the primary transfer roller 5.

Next, a third exemplary embodiment of the present invention will be described in detail below. An image forming apparatus according to the present exemplary embodiment is similar to that described in the first exemplary embodiment in basic configuration and operations. Accordingly, constituent components that are similar to those described in the first exemplary embodiment in functions and/or configurations are denoted by using the same reference numerals and redundant description thereof will be avoided.

In the present exemplary embodiment, the impedance (i.e., electric resistance) of the primary transfer roller 5 opposing the larger-diameter photosensitive drum 1 is set to be higher than the impedance (i.e., electric resistance) of the primary transfer roller 5 opposing the smaller-diameter photosensitive drum 1. The present exemplary embodiment is similar to the first exemplary embodiment in that the shift amount of the primary transfer roller 5 in relation to the larger-diameter photosensitive drum 1 is set to be greater than the shift amount of the primary transfer roller 5 in relation to the smaller-diameter photosensitive drum 1. In the present exemplary embodiment, the linear load of the primary transfer roller 5 opposing the larger-diameter photosensitive drum 1 is set to be equivalent to the linear load of the primary transfer roller 5 opposing the smaller-diameter photosensitive drum 1. However, if it is desirable, similar to the first exemplary embodiment, the linear load of the primary transfer roller 5 opposing the larger-diameter photosensitive drum 1 can be set to be greater than the linear load of the primary transfer roller 5 opposing the smaller-diameter photosensitive drum 1.

Even if the primary transfer roller 5 has a higher impedance, the current amount required in the primary transfer at the primary transfer portion T1 substantially depends on a toner charging amount and the latitude can be maintained to a certain extent. Therefore, it can be considered that the required current amount is substantially the same. More specifically, when the impedance of the primary transfer roller 5 is increased, the voltage required at the primary transfer portion T1 becomes higher. Therefore, the electric field formed at the primary transfer portion T1 becomes greater.

When the greater electric field is formed at the primary transfer portion T1, the toner image disturbance phenomenon occurring due to abnormal discharge can be suppressed adequately. More specifically, by increasing the electric field at the primary transfer portion T1, it becomes possible to increase the occurrence frequency of the abnormal discharge occurring between the photosensitive drum 1 and the intermediate transfer belt 7 on the downstream side of the primary transfer portion. As a result, the uneven pitch of the toner charging amount on the intermediate transfer belt 7 becomes fine and it becomes possible to prevent the toner image disturbance from being visually confirmed. More specifically, the present exemplary embodiment nullifies the function corresponding to the stabilization of the discharge state realized in the first exemplary embodiment by increasing the linear load to form a stable nip.

In the present exemplary embodiment, the primary transfer roller 5 opposing the smaller-diameter photosensitive drum 1 is set to have an impedance (volume resistivity) of $1.0\times10^6$ to $5.0\times10^6$ [Ω·cm]. On the other hand, the primary transfer roller 5 opposing the larger-diameter photosensitive drum 1 is set to have an impedance of $1.0\times10^7$ to $5.0\times10^7$ [Ω·cm]. As mentioned above, in the present exemplary embodiment, the electric resistance of the second transfer roller 5K is greater than the electric resistance of the first transfer rollers 5Y to 5C.

Accordingly, the present exemplary embodiment brings a preferable effect of preventing an abnormal crater from occurring on an image and widening the transfer latitude.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107608, filed May 23, 2014, which is hereby incorporated by reference herein in its entirety.

What is claimed is:

1. An image forming apparatus comprising:

a first photosensitive drum, having a first outer diameter, wherein a toner image is formed on the first photosensitive drum;

a second photosensitive drum, having a second outer diameter, wherein a toner image is formed on the second photosensitive drum, and wherein the second outer diameter is greater than the first outer diameter;

a movable endless intermediate transfer belt configured to temporarily carry the toner images transferred from the first and second photosensitive drums;

a first transfer roller configured to be pressed toward the first photosensitive drum across the intermediate transfer belt and configured to electrostatically transfer the toner image from the first photosensitive drum to the intermediate transfer belt, wherein a rotation center of the first transfer roller is disposed on a downstream side of a rotation center of the first photosensitive drum by a first shift amount in a moving direction of the intermediate transfer belt;

a second transfer roller configured to be pressed toward the second photosensitive drum across the intermediate transfer belt and configured to electrostatically transfer the toner image from the second photosensitive drum to the intermediate transfer belt, wherein a rotation center of the second transfer roller is disposed on a downstream side of a rotation center of the second photosensitive drum by a second shift amount, wherein the second shift amount is greater than the first shift amount, in the moving direction of the intermediate transfer belt, and wherein each of the first transfer roller and the second transfer roller has a crown shape of which a radius at a central portion in a rotational axis direction is greater than a radius at an end portion in the rotational axis direction, and the second transfer roller is set to be greater than the first transfer roller in a difference between the radius at the central portion and the radius at the end portion;

a first pressing mechanism configured to press the first transfer roller with a first pressing force toward the first photosensitive drum; and a second pressing mechanism configured to press the second transfer roller with a second pressing force toward the second photosensitive drum, wherein the second pressing force is greater than the first pressing force.

2. The image forming apparatus according to claim 1, wherein the intermediate transfer belt includes a plurality of layers, and wherein hardness of a surface of an intermediate transfer belt carrying the toner image is lower than hardness of another surface of an intermediate transfer belt carrying no toner image.

3. The image forming apparatus according to claim 1, further comprising another first photosensitive drum, wherein the first photosensitive drums and the second photosensitive drum are aligned in such a way as to face an external circumferential surface of the intermediate transfer belt, and the second photosensitive drum is disposed at a downstream side of the aligned first photosensitive drums in the moving direction of the intermediate transfer belt.

4. The image forming apparatus according to claim 1, wherein the first transfer roller has a first electric resistance value, wherein the second transfer roller has a second electric resistance value, and wherein the second electric resistance value is greater than the first electric resistance value.

5. The image forming apparatus according to claim 1, wherein the intermediate transfer belt includes at least an elastic layer.

6. The image forming apparatus according to claim 1, wherein the intermediate transfer belt includes a base layer and an elastic layer.

7. The image forming apparatus according to claim 1, wherein the intermediate transfer belt includes a base layer, an elastic layer, and a surface layer.

* * * * *